United States Patent [19]

Huet et al.

[11] 4,186,911

[45] Feb. 5, 1980

[54] JACK WITH TRANSLATION AND ROTATION MOVEMENTS

[76] Inventors: Jean P. Huet, rue de Villiersfins; Alain Courtois, "La Picardiére" Villiersfins, both of 41000 Blois, France

[21] Appl. No.: 906,885

[22] Filed: May 17, 1978

[30] Foreign Application Priority Data

May 20, 1977 [FR] France ..... 77 15599

[51] Int. Cl.[2] ..... F01B 21/00

[52] U.S. Cl. ..... 254/93 R; 92/2; 92/117 R

[58] Field of Search ..... 92/2, 117, 165 R, 165 PR; 297/349; 248/425, 404; 254/84, 85, 87, 93 R; 269/60, 61

[56] References Cited

U.S. PATENT DOCUMENTS

| | | | |
|---|---|---|---|
| 904,919 | 11/1908 | Baldwin | 254/93 R |
| 3,089,680 | 5/1963 | Deve | 92/117 R |
| 3,135,165 | 6/1964 | Ciallie | 92/117 R |
| 3,815,479 | 6/1974 | Thompson | 92/2 |

*Primary Examiner*—Robert C. Watson

*Attorney, Agent, or Firm*—Edwin E. Greigg

[57] ABSTRACT

The jack includes conventionally a rod mounted in the cylinder and moved in translation with respect to the latter by any known means. This jack is characterized in that the rod is fast in rotation with a bearing in which it is slideably mounted if necessary in fluid-tight manner, said bearing being mounted in the cylinder head end or in an element fast to the latter. A rotation actuating device is provided to directly or indirectly rotate the bearing so that the rod can be driven at will with a translation movement or a rotation movement or with a combination of these two movements. The invention is particularly useful in automation.

2 Claims, 3 Drawing Figures

27
25
34
26
III
III
36
35
32
28
22
21
33
24
23
30
31
29

JACK WITH TRANSLATION AND ROTATION MOVEMENTS

BACKGROUND OF THE INVENTION

1. Field of the Invention

The invention relates to a jack whose rod can be actuated with a translational movement or a rotational movement or with a combination of these two movements.

2. Description of the Prior Art

Hydraulic, pneumatic and oleopneumatic jacks and generally jacks with a piston and a pressurizing agent as well as electrical jacks are well known. They include a rod which is mounted in a cylinder and which is driven in translation with respect to the latter. In jacks with a pressurizing agent, the rod is fast to a piston which slides in fluid-tight manner in the cylinder whilst intake and exhaust passages for said agent are formed in the two ends of the cylinder so that the piston can be driven with a translational movement called "rise and fall".

However it is often necessary, in the field or automation for example, to have jacks available whose rod is capable of being actuated in addition to its conventional rise and fall movement, with a rotational movement, so that, for example, an arm fixed to the end of the rod benefits from these two movements if necessary combined.

This is why a jack has been conceived which is provided with a cylinder and a piston, both having a curvilinear triangular section so that they are fast in rotation whilst the cylinder is rotatably mounted in a support in such a way that it is possible, by means of a suitable device, to rotate the cylinder at will and through this fact, the rod which is fast to the piston.

This device has numerous drawbacks. Firstly, its cost price is particularly high, given principally the difficulty of producing a bore of curvilinear triangular cross-section. In addition, a great disadvantage resides in the fact that the machining of the cylinder is limited. In fact, apparatus capable of producing bores of this type is not only onerous, but has technological limitations as to length, which restricts the possibilities since the travel of the rod depends obviously on the length of the cylinder.

GENERAL DESCRIPTION OF THE INVENTION

Accordingly, the invention provides a jack including a rod mounted in a cylinder and driven in translation with respect to the latter by any conventional means, for example hydraulic, pneumatic, oleopneumatic, electrical or magnetic. This jack is remarkable in that the rod is fast in rotation with a bearing in which it is slideably mounted, if necessary in fluid-tight manner, said bearing being mounted in the end of the head of said cylinder or in an element fast to the latter, whilst a rotary drive device is provided to directly or indirectly rotate said bearing so that the rod can be driven at will with a movement of translation or a movement of rotation or with a combination of these two movements.

Advantageously to make the rod and the bearing fast in rotation, said rod has a substantially polygonal cross-section, preferably curvilinear and substantially oval, whilst the bearing has a bore of conjugate shape.

It is clear that in this case the cylinder can have a circular section, whilst the production of a rod having a polygonal or oval section and of a bearing limited in length, having a conjugate bore, is relatively simple and practically without limitation.

According to one embodiment of the invention, the bearing is fast to the end of the head of the cylinder and the cylinder or preferably a member connected to the latter, such as a pinion is mounted rotatably in a base whilst a rotary drive device for the cylinder or said member is provided so that the bearing and hence the rod, can be indirectly driven in rotation.

According to another embodiment, the bearing is rotatably mounted in the end of the head of the cylinder or in an element fast to the latter by means for example of bearings whilst a rotary drive device is provided to directly rotate said bearing.

In this case, for a jack with a piston, the latter is advantageously rotatably mounted by means for example, of a roller bearing system at the end of the rod so that the latter does not drive said piston in its rotary movement.

The rotary drive device is, for example, constituted by a rack or by an endless screw which cooperates with a conjugate toothing formed on the cylinder or the member to which it is fast or respectively the bearing, the rack being, for example, actuated by a jack.

In addition, the invention is adaptable to conventional already-existing jacks.

BRIEF DESCRIPTION OF THE DRAWINGS

The invention will be better understood on reading the description which follows and on studying the accompanying drawing in which.

DESCRIPTION OF PREFERRED EMBODIMENTS

Figure 1:
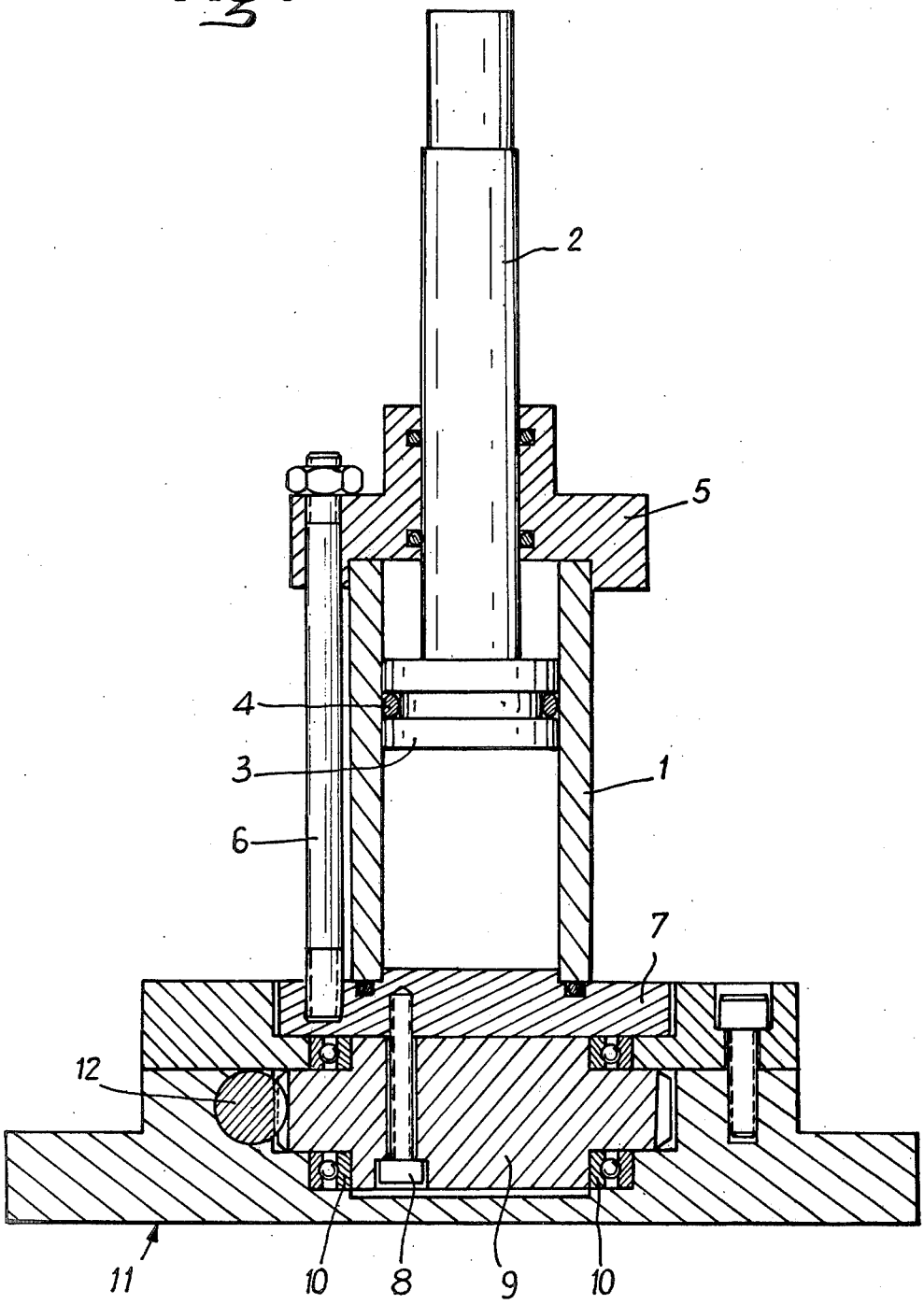
FIG. 1 is a diagrammatic longitudinal section of an embodiment of a jack according to the invention.

FIG. 1 shows a first embodiment of a jack according to the invention which comprises a cylinder 1, a rod 2 and a piston 3. The piston 3 of circular section is slideably mounted in the cylinder 1 by means of a fluid-tight seal 4. The head end of the cylinder 1 has a bearing 5 which is fixed by means of a threaded rod 6 and a nut to a support 7 arranded in fluid-tight manner at the other end of the cylinder, so that the cylinder 1, the bearing 5 and the support 7 form one unit. The rod 2 is slideably mounted in fluid-tight manner in the bearing 5. Said rod has a substantially curvilinear polygonal section such as that shown in FIG. 3, whilst the bearing 5 has a corresponding bore. It is hence clear that the bearing 5 and the rod 2 are fast in rotation.

The support 7 is fixed, for example, by means of the bolt 8, to a pinion 9. The latter is rotatably mounted, by means of ball-bearings 10 in a fixed base 11. A rack 12 is tangentially mounted to the pinion 9 so as to be able to drive it. Said rack 12 is, for example, actuated by a jack as in the embodiment shown in FIGS. 2 and 3.

The operation is clear. The piston 3 is driven in translation by a conventional device (not shown) with a pressurizing agent. When the rack 12 causes the pinion 9 to rotate, the latter drives in rotation the support 7, the cylinder 1 and the bearing 5 and hence consequently the rod 2. It is therefor possible to actuate the rod 2 with a conventional translational movement and a rotational movement. These two movements which can be obtained separately, are capable also of being combined in any manner by controlling the devices for actuating or driving each of these movements.

The free end of the rod 2 can be fastened to an arm (not shown) mounted perpendicularly whose end can then reach any of the points of the surface of a cylinder of radius equal to the length of said arm and of height equal to the length of the stroke of the rod.

Figure 2:
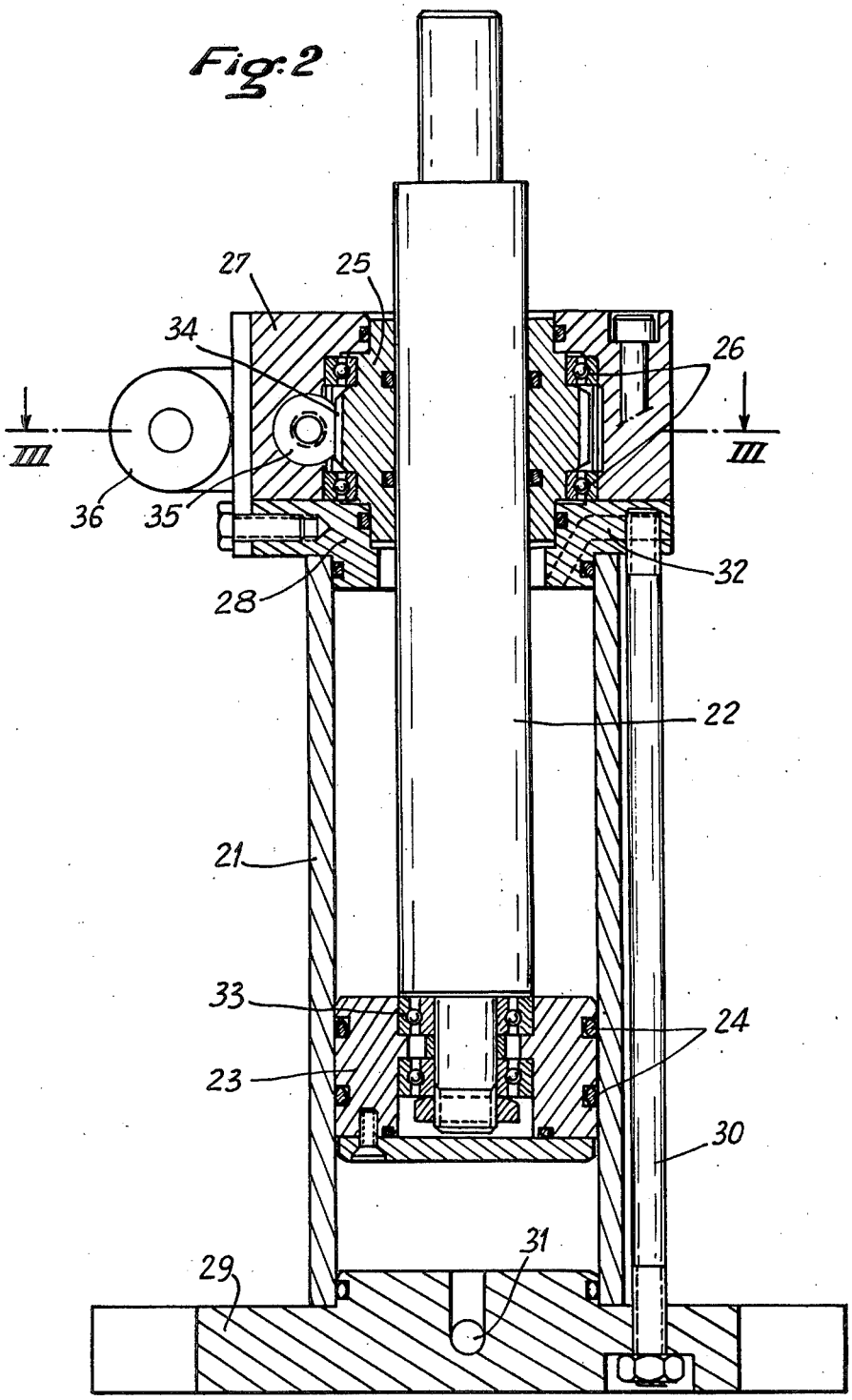
FIG. 2 is a diagrammatic longitudinal section of another embodiment of a jack according to the invention.
Figure 3:
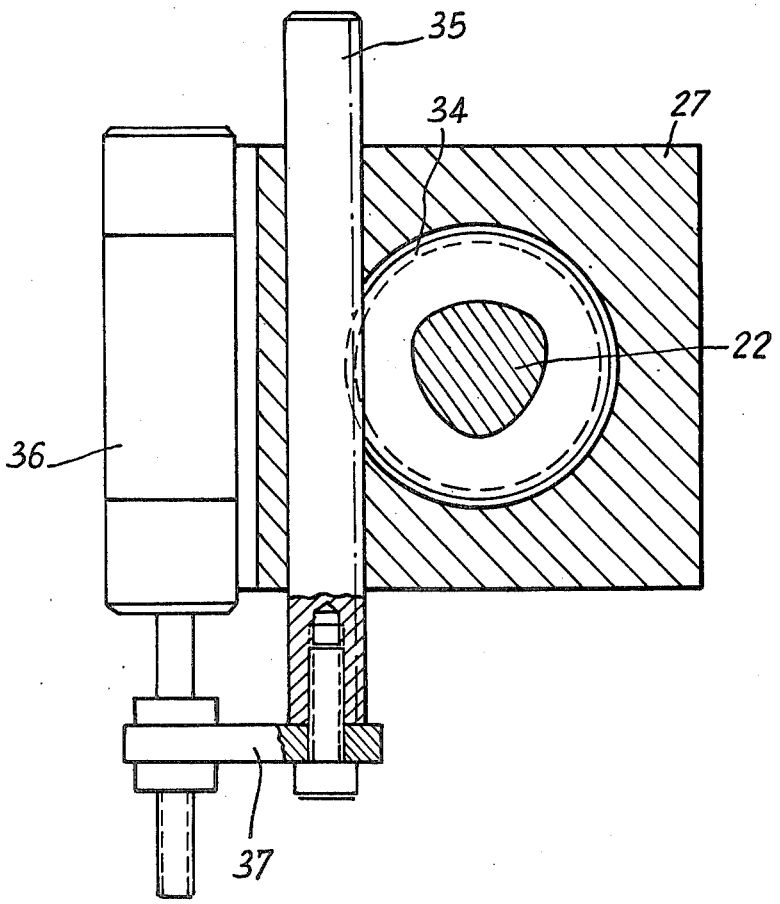
FIG. 3 is a section along the line III—III of the FIG. 2.

FIGS. 2 and 3 show another embodiment in which the jack includes a cylinder 21 of circular section, a rod 22 and a piston 23. The latter is slideably mounted in fluid-tight manner in the cylinder 21 by means of fluid-tight seals 24. The head end of the cylinder has also a bearing 25. However, this bearing is rotatably mounted by means of ball-bearings 26 in an element or head 27, which is fixed through a coupling 28 to a base 29 by means of a threaded rod with a nut 30. Said base 29 is arranged at the other end of the cylinder and closes the latter in sealed manner. It is clear that the head 27, the cylinder 21 and the base 29 form one unit. The base 29 and the coupling 28 have in addition passages respectively 31 and 32 for intake and/or the exit of a pressurizing agent.

As in the preceding embodiment, the rod 22 is slideably mounted in fluid-tight manner in the bearing 25, whilst they both have substantially conjugated curvilinear polygonal sections, here substantially triangular. Moreover, the piston 23 is rotatably mounted at the end of the rod 22 by means of bearing 33.

The bearing 25 has a peripheral toothing 34 designed to cooperate with rack 35 mounted tangentially to said bearing. The rack is driven by a jack 36 arranged parallel to said rack and whose rod is made fast to the end of the rack by means of a bracket 37.

This embodiment enables as with the preceding embodiment described, the combination of a translational movement and a rotational movement.

However, here, it is the bearing 25 which is directly actuated in rotation and which drives the rod in its movement whilst the cylinder is fixed in position. The arrangement which permits the mounting of the rotary piston 23 at the end of the rod 22 is not obligatory, but has the advantage of eliminating the effects of friction in rotation of the piston which remains in fixed angular position with respect to the cylinder 21.

Numerous modifications or variations can be introduced into these embodiments without departing from the scope of the invention. Thus for example the rotary drive device may be any other and notably constituted by an endless screw. In addition, the invention can be applied to any sort of jack and it is not limited to the jacks with a piston and pressurizing agent which have been more particularly described.

We claim:

1. A jack comprising a cylinder, a piston mounted at the end of a rod which is moved in translation in said cylinder by any pressurizing agent such as hydraulic, pneumatic or oleopneumatic, said jack including a translation bearing mounted in the end of the head of said cylinder, said bearing having a bore of substantially polygonal, curvilinear or oval cross-sectional shape, said rod being slidably mounted in fluid-type manner in said bore and having over the major part of its length a cross-sectional shape corresponding to the cross-sectional shape of said bore so that said rod and said bearing rotate together and said rod is movable in translation in a guided manner in said bearing bore, a base, means for rotatably mounting said cylinder in said base for rotation about the longitudinal axis of said cylinder, a rotation actuating device for rotating said cylinder and hence indirectly said bearing and said rod so that said rod can be actuated selectively with a movement of translation or a movement of rotation or with a combination of these two movements.

2. A jack according to claim 1, wherein said means for rotatably mounting said cylinder in said base comprises a pinion connected to the lower end of said cylinder rotatably mounted in said base and wherein said rotation actuating device comprises a rack which cooperates with said pinion.

* * * * *